United States Patent [19]

Fortenberry

[11] 4,326,652

[45] Apr. 27, 1982

[54] KNIFE SHEATH STRUCTURE

[76] Inventor: Charles K. Fortenberry, 3112 Vandenberg, Wichita, Kans. 67210

[21] Appl. No.: 228,140

[22] Filed: Jan. 26, 1981

[51] Int. Cl.[3] ..... B26B 29/02

[52] U.S. Cl. ..... 224/232; 7/120; 30/151; 224/240; 224/252; 224/253

[58] Field of Search ..... 224/228, 231–236, 224/238, 240, 252, 253, 269, 911, 914; 30/151, 164, 143; 7/120, 160, 167

[56] References Cited

U.S. PATENT DOCUMENTS

| | | | |
|---|---|---|---|
| 884,030 | 4/1908 | Morton | 7/120 |
| 1,538,641 | 5/1925 | Liljeqvist | 7/160 |
| 2,387,900 | 10/1945 | Hartwell | 224/232 |
| 2,650,008 | 8/1953 | Morseth | 224/253 |
| 2,687,833 | 8/1954 | Sutton | 224/232 |
| 2,910,216 | 10/1959 | Bennet | 30/151 |
| 3,533,540 | 10/1970 | Carinci | 224/232 |
| 3,576,278 | 4/1971 | Eastman | 224/232 |
| 3,992,776 | 11/1976 | Koppe et al. | 224/232 |

FOREIGN PATENT DOCUMENTS

| | | | |
|---|---|---|---|
| 28514 | of 1909 | United Kingdom | 7/120 |
| 826867 | 1/1960 | United Kingdom | 224/232 |

*Primary Examiner*—Stephen Marcus

*Attorney, Agent, or Firm*—Phillip A. Rein

[57] ABSTRACT

This invention is a knife sheath structure readily connected to a belt member adapted to receive and convey a knife member therein. The knife sheath structure includes (1) a main knife support assembly to vertically and laterally support the knife member therein; (2) a vertical support assembly secured to the main knife support assembly and releasably connectable to the belt member; (3) a cover assembly secured to the main knife support assembly adapted to cover a portion of the knife member to restrict upward and lateral movement thereof; (4) a sharpener and connector assembly connected to the vertical support assembly. The sharpener and connector assembly includes a connector ring having a sharpener plate member secured thereto. The connector ring is of rectangular shape adapted to receive a portion of the main knife support assembly to connect to the belt member and a portion of the cover assembly to hold the knife member in a conveyance position. The sharpener plate member is of a hardened material whereby a blade of the knife member can be sharpened thereon. The knife sheath structure is easily attached and removed from the belt member; provides substantial security to the knife member; and adapted to receive and convey another knife sheath structure thereon.

6 Claims, 4 Drawing Figures

KNIFE SHEATH STRUCTURE

PRIOR ART

A search of the prior art only revealed the following U.S. Pat. Nos. 3,533,540, 3,992,776

The Koppe patent discloses the use of a clip member to hold a knife member within a support knife sheath and to connect same to a person's belt member.

The Carinci patent is pertinent in teaching a similar means of connecting to a person's belt member. However, Carinci does not have the features of a cover assembly or use of a sharpener plate member as set forth in the applicant's invention herein.

PREFERRED EMBODIMENT OF THE INVENTION

In one preferred embodiment of the invention, a Knife Sheath Structure includes (1) a main knife support assembly adapted to receive and support a knife member therein; (2) a vertical support assembly secured to the main knife sheath assembly and connectable to a person's belt member; (3) a cover assembly secured to the main knife support assembly operable to enclose a portion of the knife member; and (4) a sharpener and connector assembly connected to the vertical support assembly. The main knife support assembly is constructed of a plurality of layers to enclose a knife blade of the knife member to support and protect same. The cover assembly is contoured to the shape of a handle portion of the knife member to protect and restrict vertical movement thereof. The sharpener and connector assembly includes a sharpener plate member secured to a connector ring. The sharpener plate member is of a hardened steel whereby the knife blade can be periodically sharpened thereon. The connector ring is of generally rectangular shape and (1) receives a portion of the main knife support assembly therein to receive the belt member between the vertical support assembly and the main knife support assembly; and (2) receives a portion of the cover assembly therein to enclose and hold the knife member.

OBJECTS OF THE INVENTION

One object of the invention is to provide a Knife Sheath Structure that is easily attached and removed from a support belt member with a minimum amount of effort.

Another object of the invention is to provide a Knife Sheath Structure adapted to receive, support, enclose, and protect a knife member.

A further object of this invention is to provide a Knife Sheath Structure having a sharpener plate member operable to sharpen a knife blade thereon.

One further object of this invention is to provide a Knife Sheath Structure operable to receive and convey a second Knife Sheath Structure thereon.

Still another object of this invention is to provide a Knife Sheath Structure that is compact in construction; easy to use; attractive in appearance; and having safety features.

Various other objects, advantages, and features of the invention will become apparent to those skilled in the art from the following discussion, taken in conjunction with the accompanying drawings, in which:

FIGURES OF THE INVENTION

Figure 2:
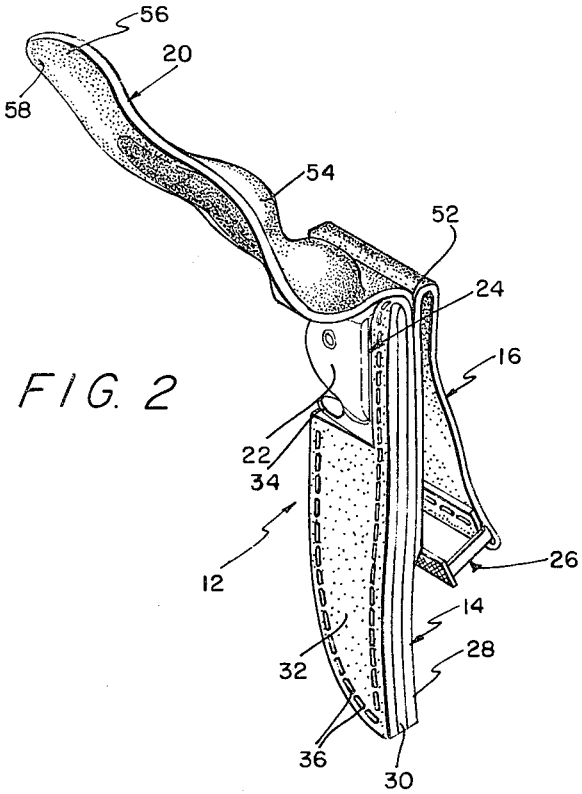
FIG. 2 is a perspective view of the Knife Sheath Structure of this invention with a knife member therein.

The following is a discussion and description of a preferred specific embodiment of the new Knife Sheath Structure of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
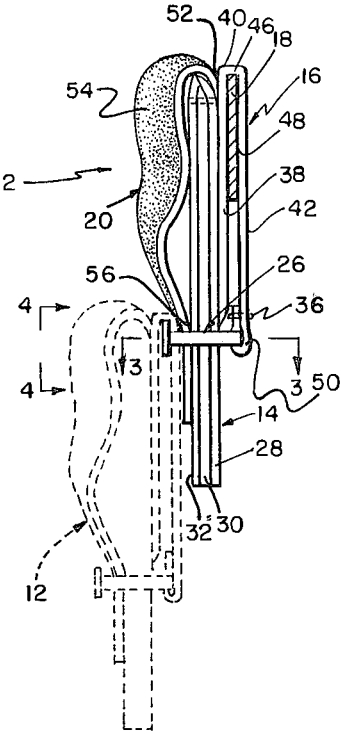
FIG. 1 is a side elvational view of a Knife Sheath Structure of this invention with a second identical Knife Sheath Structure connected thereto as shown in dotted lines.
Figure 3:
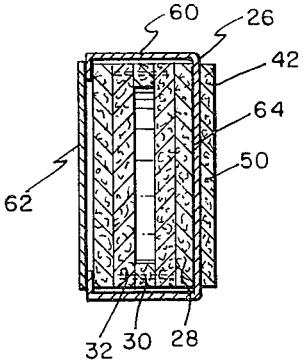
FIG. 3 is an enlarged sectional view taken along line 3—3 in FIG. 1.

Referring to the drawings in detail and in particular to FIG. 1, a Knife Sheath Structure of this invention, indicated generally at 12, includes (1) a main knife support assembly 14; (2) a vertical support assembly 16 connectable to a person's belt member 18; (3) a cover assembly 20 secured to the main knife support assembly 14 operable to enclose a handle portion 22 of a knife member 24; and (4) a sharpener and connector assembly 26 connected to the vertical support assembly 16.

The main knife support assembly is of a leather layer construction having a back support member 28; an intermediate support or spacer member 30; and a front support member 32. The back support member 28 resembles in shape the outline of the knife member 24 being carried thereby.

The intermediate support member 30 is of a J-shape and the thickness of a knife blade of the knife member 24 carried therein.

The front support member 32 also resembles the outline of the knife member 24 except having a handle portion 34 cut away for obvious reasons.

As noted in FIG. 2 the support member 28, 30, and 32 of the main knife support assembly 14 are secured together into a unit as by stitching indicated at 36.

The vertical support assembly 16 resembles a strap member having an anchor section 38; an intermediate section 40; and a connector section 42. The anchor section 38 is secured by the stitching 36 to a back surface 44 of the back support member 28. It is seen that the anchor section 38 rests against one side of the belt member 18 when in the conveyance condition.

The intermediate section 40 drapes about an upper sidewall 46 and a back surface 48 of the belt member 18 when being carried as shown in FIG. 1.

The connector section 42 is formed with a loop 50 to enclose a portion of the sharpener and connector assembly 26. The loop 50 is anchored in its shape as by stitching 36.

The cover assembly 20 is contoured to custom fit the handle portion 22 of the knife member 24 being carried therein. The cover assembly 20 includes a connector portion 52; a contoured main body portion 54 integral with the connector portion 52; and a connector flange portion 56 integral with the main body portion 54. The connector flange portion 56 has an outer tapered section 58 similar to a tongue or lead portion on a conventional person's belt member.

The sharpener and connector assembly 26 includes a connector ring 60 with a sharpener plate member 62 connected thereon. The connector ring 60 is of rectangular shape having a back wall 64 surrounded and connected to the loop 50 of the vertical support assembly 16. The connector ring 60 is of a size to receive the main knife support assembly 14 therein plus a portion of the connector flange portion 56 in a manner to be explained.

Figure 4:
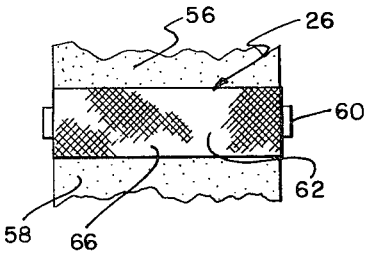
FIG. 4 is an enlarged fragmentary elevational view taken along line 4—4 in FIG. 1.

As seen in FIG. 4, the sharpener plate member 62 is formed with a hardened gut finish 66 that is operable to receive a knife blade thereon for sharpening purposes. This provides a readily accessible and convenient surface to sharpen the knife member 24 whenever desired.

USE AND OPERATION OF THE INVENTION

In the use and operation of this invention, the Knife Sheath Structure 12 is readily attached to the belt member 18 by first placing the vertical support assembly 16 around the belt member 18 as shown in FIG. 1. Next, the main knife support assembly 14 is raised and inserted through the connector ring 60 into the position indicated in FIG. 1.

The knife member 24 is then placed within the main knife support assembly 14 and vertically supported therein as shown in FIG. 2. The main knife support assembly 14 is designed and contoured to receive the blade member of the knife member 24 to protect same and restrict lateral movement thereof.

The cover assembly 20 is then placed over the knife member 24 with the contoured main body portion 54 conforming to the shape of the knife member 24. The connector flange portion 56 is then inserted through the connector ring 60 to restrict lateral and vertical movement of the knife member 24.

As noted in FIG. 1, in dotted lines, a second (and perhaps more) Knife Sheath Structure 12 may be attached to the first Knife Sheath Structure 12 connected to the belt member 18. The second vertical support assembly 16 is connected to the connector ring 60 in a manner as described for the connection of the first Knife Sheath Structure 12 to the belt member 18. It is seen that the knife member 24 can be removed from respective Knife Sheath Structure's 12 as desired.

It is noted that the main knife support assembly 14, the vertical support assembly 16, and the cover assembly 20 is preferrably constructed of a leather material but could be constructed of any suitable flexible material.

The sharpener plate member 62 may be constructed of any knife blade sharpening material such as whetstone or a material impregnated with diamonds.

While the invention has been described in conjunction with preferred specific embodiments thereof, it will be understood that this description is intended to illustrate and not to limit the scope of the invention, which is defined by the following claims.

I claim:

1. A Knife Sheath Structure adapted to be connected to a person's belt member or the like, comprising:

(a) a main knife support assembly adapted to receive and support a knife member therein;

(b) a vertical support assembly secured to said main knife support assembly and connectable to the belt member;

(c) a cover assembly secured to said main knife support assembly and operable to enclose and cover a handle portion of the knife member; and (d) a connector assembly connected to said vertical support assembly to receive a portion of said main knife support assembly and said cover assembly therein to prevent vertical and lateral movement of the knife member therefrom.

2. A Knife Sheath Structure as described in claim 1, wherein:

(a) said cover assembly having a connector portion secured to said main knife support assembly and a connector flange portion;

and (b) said connector flange portion inserted in said connector assembly to restrict lateral and vertical movement of the knife member.

3. A Knife Sheath Structure as described in claim 1, wherein: p1 (a) said connector assembly includes a sharpener plate member adapted to receive a blade member of the knife member thereon for sharpening purposes.

4. A Knife Sheath Structure as described in claim 1, wherein:

(a) a second Knife Sheath Structure is connected by its vertical support assembly to said first Knife Sheath Structure.

5. A Knife Sheath Structure as described in claim 1, wherein:

(a) said connector assembly includes a connector ring having a sharpener plate member secured thereto.

6. A Knife Sheath Structure as described in claim 5, wherein:

(a) said sharpener plate member being constructed of hardened steel in order to sharpen a blade member of the knife member thereon.

* * * * *